US008235242B2

(12) United States Patent
Ha

(10) Patent No.: US 8,235,242 B2
(45) Date of Patent: Aug. 7, 2012

(54) ANTI-SLOSHING STRUCTURE FOR LNG CARGO TANK

(75) Inventor: Deog Jin Ha, Geoje-si (KR)

(73) Assignee: Samsung Heavy Ind. Co., Ltd. (KR)

( * ) Notice: Subject to any disclaimer, the term of this patent is extended or adjusted under 35 U.S.C. 154(b) by 161 days.

(21) Appl. No.: 12/743,744

(22) PCT Filed: Dec. 4, 2007

(86) PCT No.: PCT/KR2007/006226

§ 371 (c)(1),
(2), (4) Date: May 19, 2010

(87) PCT Pub. No.: WO2009/072681

PCT Pub. Date: Jun. 11, 2009

(65) Prior Publication Data

US 2010/0281887 A1 Nov. 11, 2010

(51) Int. Cl.
*B65D 88/12* (2006.01)

(52) U.S. Cl. ..... 220/563; 220/560.07; 220/567.2

(58) Field of Classification Search ..... 220/560.04, 220/560.07, 560.11, 560.13, 563, 564, 567.2, 220/652; 114/74 A, 74 R See application file for complete search history.

(56) References Cited

U.S. PATENT DOCUMENTS 2,533,431 A * 12/1950 Gaston ..... 220/563
3,319,431 A 5/1967 Clarke et al.
3,459,148 A 8/1969 Progler et al.
3,612,333 A * 10/1971 Cowles ..... 220/560.11
3,692,205 A * 9/1972 Cowles et al. ..... 220/560.03
3,882,809 A * 5/1975 Johnson et al. ..... 114/74 A
3,941,272 A * 3/1976 McLaughlin ..... 220/560.11
5,664,514 A 9/1997 Laan
6,595,382 B2 * 7/2003 Ettlinger ..... 220/560.11

(Continued)

FOREIGN PATENT DOCUMENTS

GB 1 054 641 1/1967

(Continued)

OTHER PUBLICATIONS

The extended European Search Report dated Sep. 6, 2011.

*Primary Examiner* — David Fidei

(74) *Attorney, Agent, or Firm* — Harness, Dickey & Pierce, P.L.C.

(57) ABSTRACT

The present invention relates to anti-sloshing LNG cargo tanks to mitigate a sloshing phenomenon. The anti-sloshing LNG cargo tank having a first barrier for preventing leakage of a cryogenic LNG, a second barrier and an insulation pad provided to supplement the first barrier, includes: an anti-sloshing bulkhead for partitioning a space in the LNG cargo tank into a plurality of spaces to reduce a sloshing phenomenon of the LNG that moves in the LNG cargo tank; and a stool part united at a first surface thereof to an inner wall of an LNG carrier body and united at a second surface thereof to the anti-sloshing bulkhead to fasten the anti-sloshing bulkhead to the inner wall of the LNG cargo tank. The stool part is coupled to the first barrier and the second barrier and having the insulation pad therein, thus preventing the cryogenic LNG from leaking towards the inner wall of the LNG carrier body or from exchanging heat with the inner wall of the LNG carrier body.

6 Claims, 7 Drawing Sheets

U.S. PATENT DOCUMENTS

| | | | | |
|---|---|---|---|---|
| 6,626,121 | B1 | 9/2003 | Libæk | |
| 6,907,836 | B2 * | 6/2005 | Hagner | 114/74 A |
| 6,984,452 | B2 * | 1/2006 | Kennedy | 428/423.1 |
| 2006/0162279 | A1 | 7/2006 | Bergan | |

FOREIGN PATENT DOCUMENTS

| | | | |
|---|---|---|---|
| GB | 1 378 492 | | 12/1974 |
| JP | 60-22496 | | 2/1985 |
| JP | 60088690 | A * | 5/1985 |
| KR | 20-0333611 | | 11/2003 |

* cited by examiner

[Fig. 3]
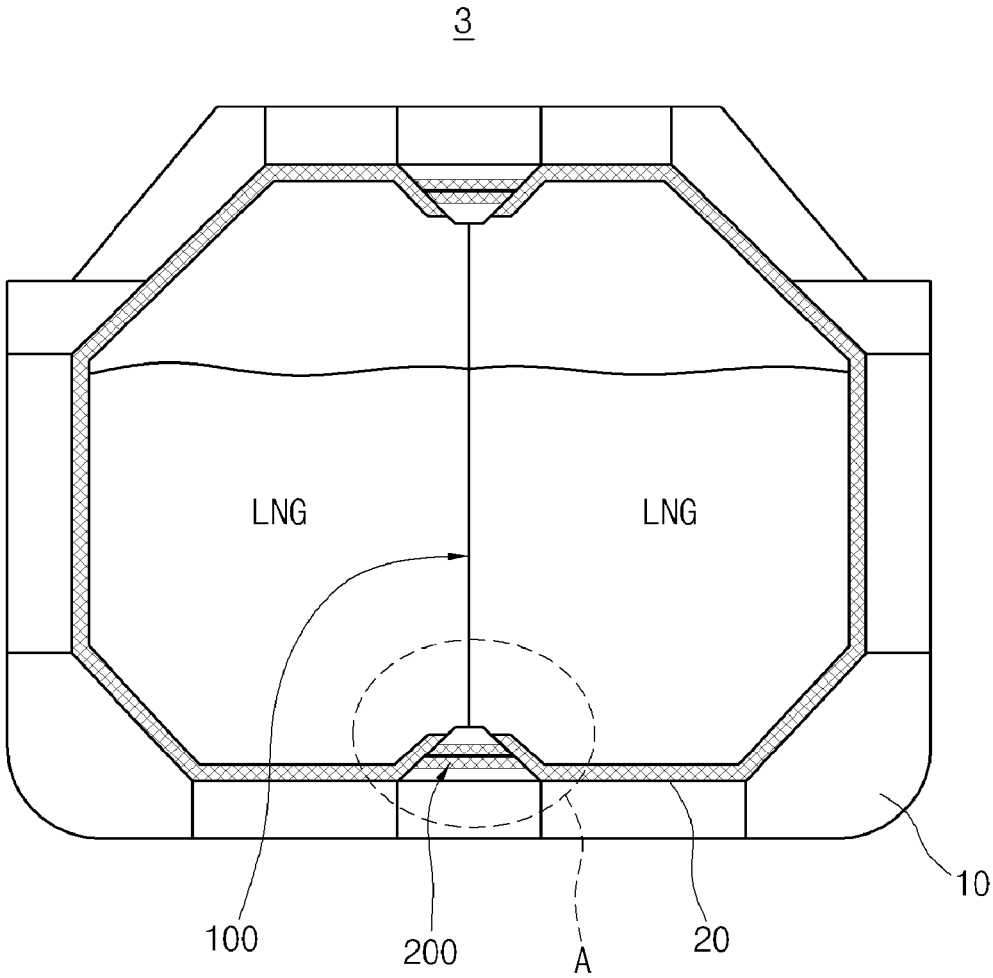

[Fig. 4]
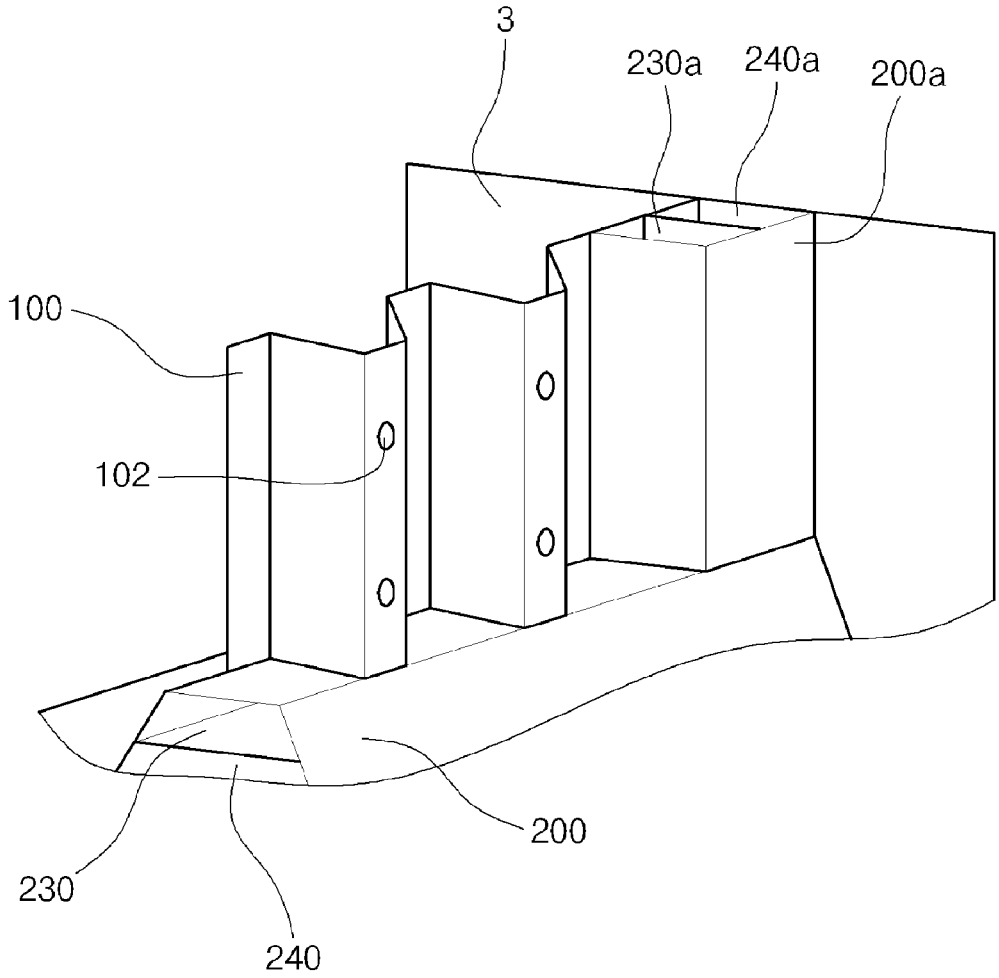

[Fig. 5]
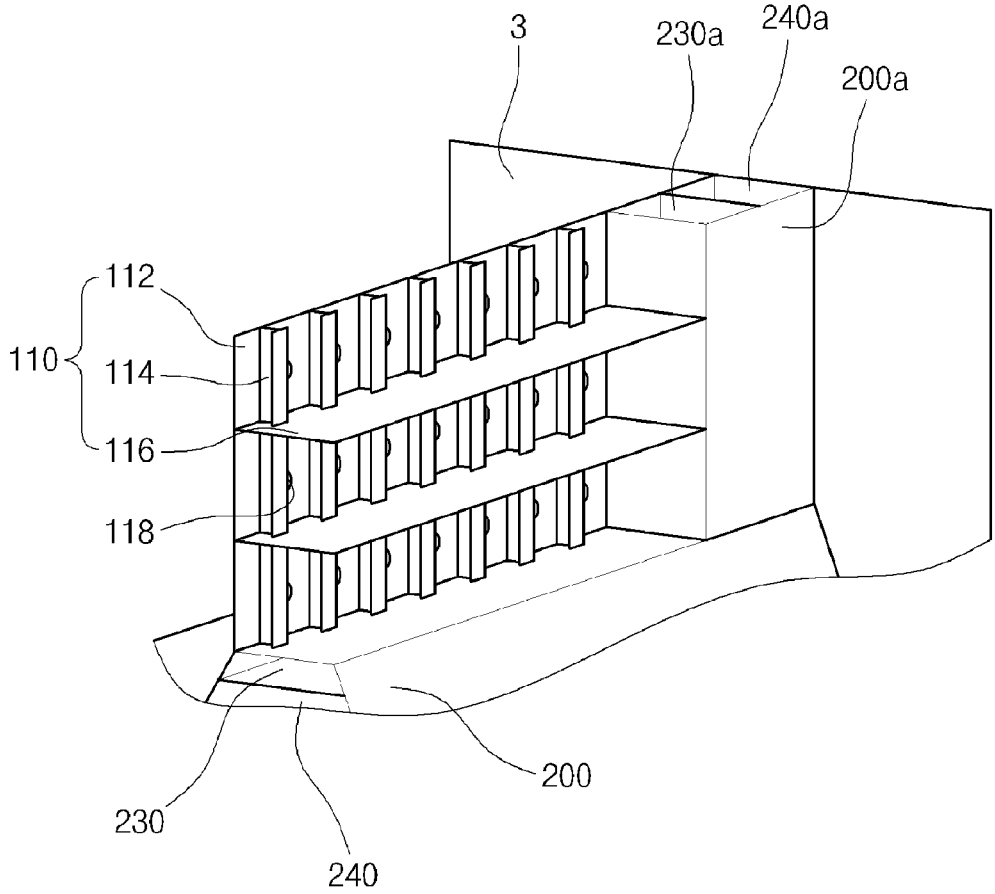

[Fig. 6]
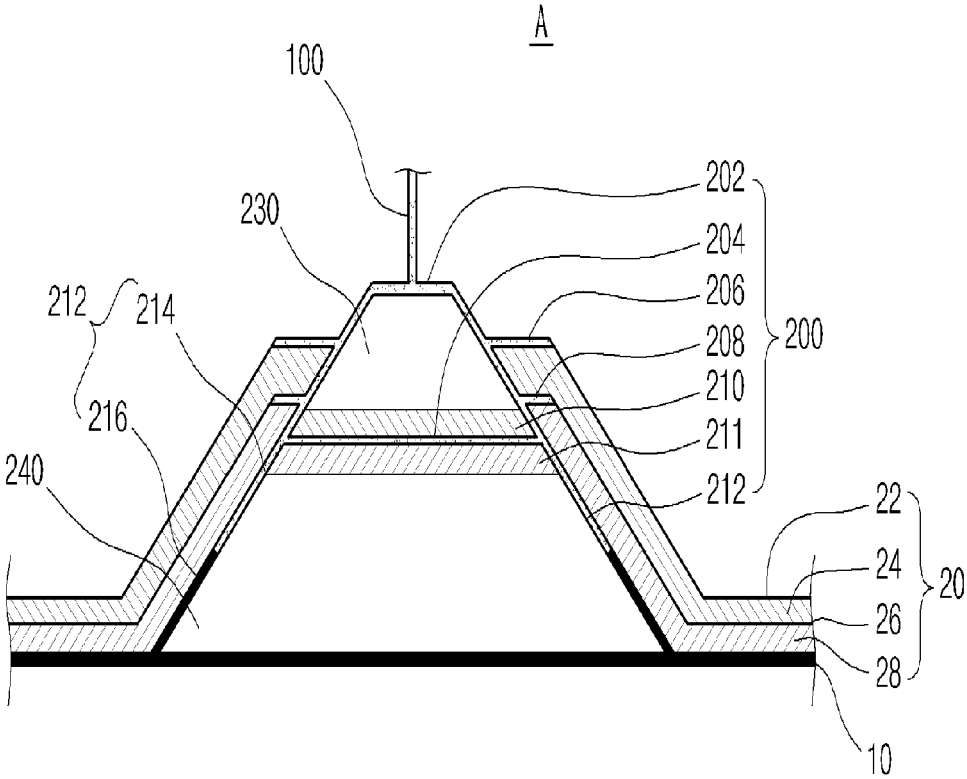
[Fig. 7]
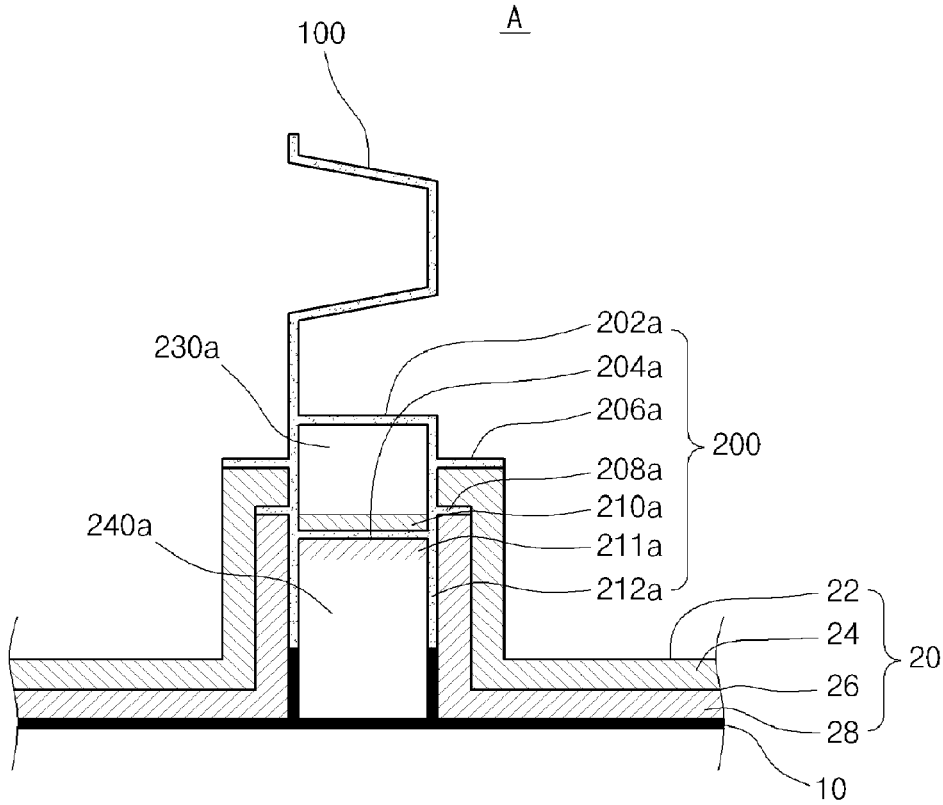

[Fig. 8]
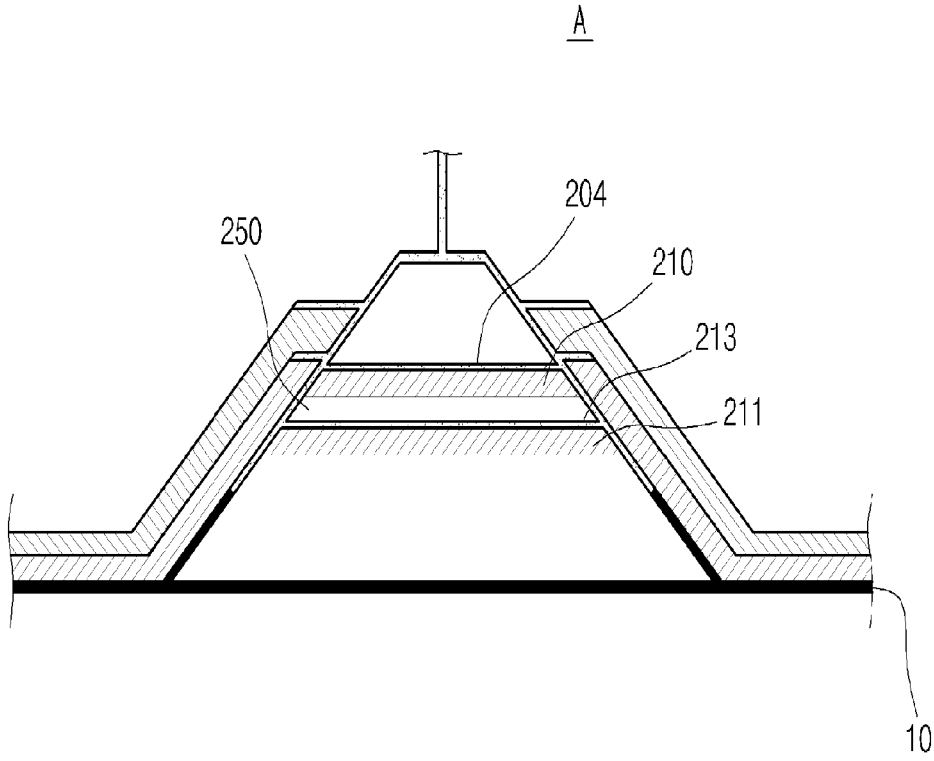
[Fig. 9]
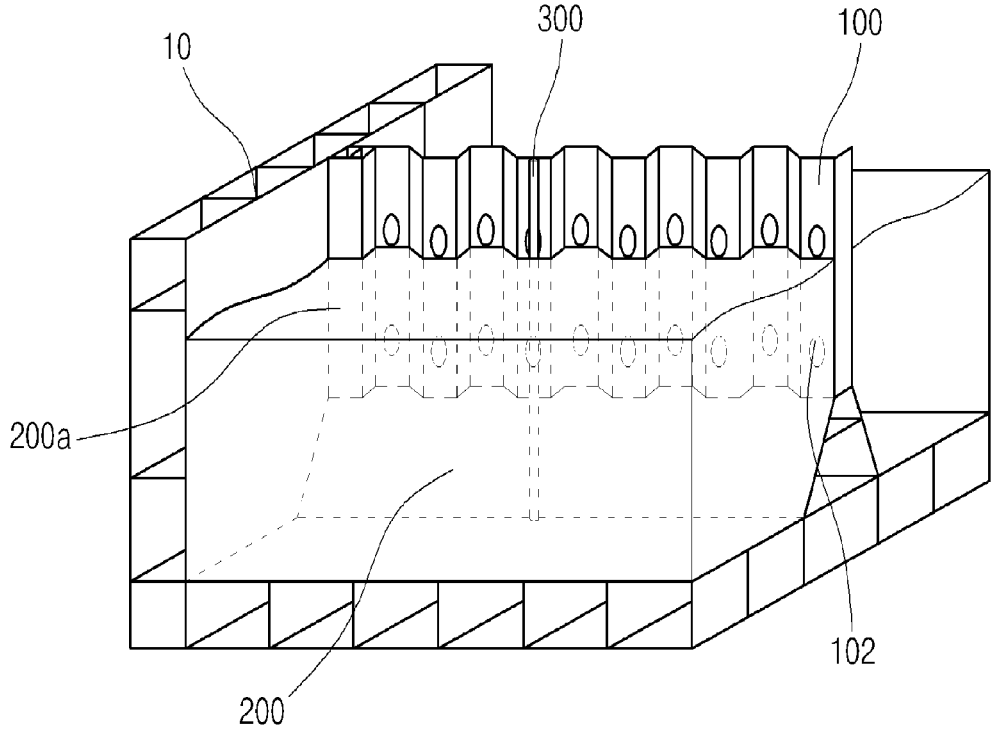

ANTI-SLOSHING STRUCTURE FOR LNG CARGO TANK

TECHNICAL FIELD

The present invention relates, in general, to anti-sloshing LNG (liquefied natural gas) cargo tanks and, more particularly, to an anti-sloshing LNG cargo tank which includes an anti-sloshing bulkhead, which partitions a space in the LNG cargo tank into two parts, that is, left and right spaces, and a stool part, which fastens the anti-sloshing bulkhead to the inner wall of the LNG cargo tank, thus mitigating a sloshing phenomenon, in which LNG moves to the left and right in the LNG cargo tank.

BACKGROUND ART

Generally, in LNG carriers, which store LNG at a cryogenic temperature (approximately −163° C.) in LNG cargo tanks and carry the LNG, the cargo tanks must have special structures, in consideration of the problem of the brittle fracture of a carrier bodies due to the cryogenic temperature of the LNG. The term 'special structure' means a structure for insulating and isolating cryogenic LNG from structural members of the carrier body or cargo tank. Typically, as the special structures, membrane structures, in which barriers having superior low-temperature resistance are provided in the structural members of the carrier body and insulating substances are interposed between the barriers, have been widely used.

FIG. 1 is a view showing a typical LNG carrier having cargo tanks. As shown in FIG. 1, in the LNG carrier 1, a plurality of cargo tanks 3 occupies almost all of the space in the carrier body, other than crew quarters 5, in which sailors reside, and a power generating part 7, which generates driving force for propelling the LNG carrier 1.

The cargo tanks 3 define therein space for storing LNG to be carried by the LNG carrier 1. A cofferdam 9, that is, a space between adjacent cargo tanks 3, is provided. The cofferdam 9 has a device for heating air therein, and thus serves to prevent the wall of the carrier body from being damaged by exchanging heat with the cargo tanks 3, which contain LNG of a cryogenic temperature therein.

FIG. 2 is a cross sectional view showing a conventional membrane type cargo tank. As shown in FIG. 2, the internal structure of the membrane type cargo tank 3 includes a carrier body inner wall 10, which is made of carbon steel, and an insulating compound barrier layer 20, which is provided on the inner surface of the carrier body inner wall 10.

The insulating compound barrier layer 20 conducts an insulating and isolating function for preventing the carrier body inner wall 10 from being damaged by LNG of a cryogenic temperature. A first barrier 22, made of stainless steel (SUS), is provided in the insulating compound barrier layer 20 at the innermost position, which is closest to the internal space of the cargo tank 3, that is, a position at which it comes into direct contact with LNG. A first insulation pad 24 is provided on the outer surface of the first barrier 22. A second barrier 26, which is made of triplex material and supplements the function of the first barrier 22, is provided on the outer surface of the first insulation pad 24. A second insulation pad 28 is provided on the outer surface of the second barrier 26. The second insulation pad 28 is in close contact with the carrier body inner wall 10, which is one of the structural members of the LNG carrier. This structure prevents the carrier body inner wall 10 from being damaged by the cryogenic LNG that is contained in the cargo tank 3.

However, in the case of marine structures, such as an LNG carrier (LNGC), which travels on the sea, and a floating storage regasification unit (FSRU), which is used at a stationary location, the structure shakes depending on sea conditions, for example, due to waves or sea wind. When the structure shakes, LNG that contained in the cargo tank 3 also moves therein. At this time, the moving LNG strikes the inner wall of the cargo tank 3. This phenomenon is called 'sloshing', and an impact applied to the inner wall by the sloshing is called a sloshing impact.

The damage to the inner wall of the cargo tank 3, attributable to the sloshing, increases as the size of the cargo tank 3 is increased. This limits the size of the cargo tank 3. Particularly, in the case of an FSRU, which is used in a state in which it is anchored for a long period of time at a specific location at sea, or an LNG carrier traveling in poor conditions, the above-mentioned limitation attributable to the sloshing becomes an important design factor.

Therefore, there is required an anti-sloshing LNG cargo tank applicable to a large LNG cargo tank of an LNG carrier or an FSRU which stores and manages LNG.

DISCLOSURE OF INVENTION

Technical Problem

Accordingly, the present invention has been made keeping in mind the above problems occurring in the prior art, and an object of the present invention is to provide an anti-sloshing LNG cargo tank that can be applied to an LNG carrier or an FSRU.

Technical Solution

In order to accomplish the above object, the present invention provides an anti-sloshing LNG cargo tank, having a first barrier for preventing the leakage of cryogenic LNG, and a second barrier and an insulation pad, provided to supplement the first barrier. The anti-sloshing LNG cargo tank includes an anti-sloshing bulkhead, which partitions the space in the LNG cargo tank into left and right spaces to reduce a sloshing phenomenon of the LNG, which moves in the LNG cargo tank, and a stool part, which is united at a first surface thereof to the inner wall of an LNG carrier body and is united at a second surface thereof to the anti-sloshing bulkhead to fasten the anti-sloshing bulkhead to the inner wall of the LNG cargo tank. The opposite surfaces of the stool part are coupled to the first barrier and the second barrier, respectively. The insulation pad is provided in the stool part. Thus, the anti-sloshing LNG cargo tank prevents the cryogenic LNG from leaking towards the inner wall of the LNG carrier body or from exchanging heat with the inner wall of the LNG carrier body.

Preferably, the anti-sloshing bulkhead may have a zigzag-corrugated shape, which has a predetermined width in a longitudinal direction of the carrier body. That is, the anti-sloshing bulkhead is disposed in the cargo tank and extends along the longitudinal axis of the carrier body such that the space in the cargo tank is partitioned into left and right spaces, thus reducing the lateral width of the cargo tank in half, thereby mitigating the sloshing phenomenon of the LNG, which moves in the cargo tank. Here, the corrugated type anti-sloshing bulkhead is configured such that it can partition the space in the cargo tank into two identical spaces, and realizes a shape that can resist buckling and twisting.

Furthermore, several holes may be formed through the corrugated type partition at positions spaced apart from each other at regular intervals. These holes are formed through the corrugated type partition, which partitions the space in the cargo tank into left and right spaces, so that the LNG contained in the cargo tank can freely flow between the left and right spaces through the holes. Therefore, LNG can be carried from the cargo tank to the outside, or from the outside into the cargo tank, using a single pump. The presence and number of holes may be changed depending on the structures of the embodiments. In the case of only a basic structure, in which the conventional membrane type cargo tank is partitioned into two independent spaces, the structure may have no holes.

Meanwhile, the anti-sloshing bulkhead may include a plate type partition, which is oriented in the longitudinal direction of the carrier body, a plurality of stiffeners, which are coupled to the plate type partition in a direction perpendicular thereto and are oriented in a vertical direction to enable the plate type partition to withstand buckling, and a plurality of stringers, which are coupled to the plate type partition in a direction perpendicular thereto and are oriented in a longitudinal direction to enable the plate type partition to withstand deformation in the longitudinal direction and twisting. The plate type anti-sloshing bulkhead has an advantage of increased strength, compared to the prior corrugated type anti-sloshing bulkhead, but it has a disadvantage in that the two partitioned spaces in the cargo tank cannot have the same shape. Therefore, depending on the volume of LNG that is contained in the cargo tank, an appropriate embodiment is selectively used.

Furthermore, several holes may be formed through the plate type partition at positions spaced apart from each other at regular intervals. The reason for the formation of the holes in the plate type partition is the same as that for the formation of the holes in the corrugated type partition.

Preferably, the anti-sloshing bulkhead may be made of stainless steel or aluminum, which has superior low-temperature resistance, so as to withstand the cryogenic-temperature of LNG. Such stainless steel or aluminum has low-temperature resistance sufficient to withstand the cryogenic temperature (approximately −163° C.) of LNG. Therefore, stainless steel or aluminum is suitable for the material of the anti-sloshing bulkhead, which is in direct contact with LNG at a cryogenic temperature.

Meanwhile, the stool part may include: a first parallel member, which is united with an edge of the anti-sloshing bulkhead; a second parallel member, which is disposed below the first parallel member; support members, which connect respective opposite edges of the first parallel member to corresponding opposite edges of the second parallel member and extend to the inner wall of the LNG cargo tank; first connection members, which extend from respective upper ends of the support members to respective first barriers and are united with the respective first barriers; and second connection members, which extend from the respective upper ends of the support members to the respective second barriers and are united with the respective second barriers. In addition, a plurality of insulation pads is provided on or under the second parallel member.

Furthermore, the stool part may further include a third parallel member, which is provided below the second parallel member at a position spaced apart from the second parallel member by a predetermined distance and is united at the opposite ends thereof to the respective upper ends of the support members. As such, in the case where the third parallel member is additionally provided, the stool part defines three sealed spaces therein. The number of sealed spaces may be changed depending on the structures of the embodiments. Thus, as necessary, the number of parallel members may be further increased so as to increase the number of sealed spaces defined in the stool part, so that the sealed spaces can be implemented in a greater variety of arrangements.

Here, a second sealed space is defined by the second parallel member, the third parallel member and the upper ends of the support members. The second sealed space comprises a single space, which is defined along the outer edges of the anti-sloshing bulkhead, so that gas is charged into the second sealed space to detect gas leakage attributable to a crack formed in the members that define the second sealed space. In the conventional cargo tank, in order to inspect whether a crack is present in the first and second barriers, pressure inspection using a method of charging gas is necessarily conducted. In the same manner, in the stool part of the present invention, in order to inspect whether a crack is present in the first parallel member, the second parallel member, the third parallel member, the first connection members, the second connection members and the support, members which constitute the stool part, pressure inspection using a method of charging gas is conducted. At this time, the second sealed space is used as a space for charging gas. For this, the second sealed space is defined by a single space, which extends along the outer edges of the anti-sloshing bulkhead, such that gas can be charged into the second sealed space to detect gas leakage attributable to a crack formed in the members, that is, the second parallel member, the third parallel member and the upper ends of the support members, which define the second sealed space. Furthermore, the second sealed space also serves as a passage used when conducting maintenance and repair of the cargo tank.

Preferably, the third parallel member is made of stainless steel or aluminum, which has superior low-temperature resistance, so as to withstand the cryogenic temperature of LNG.

In the stool part, to more reliably support the anti-sloshing bulkhead and stably couple the stool part to the inner wall of the carrier body, the width of the second parallel member is preferably greater than the width of the first parallel member. That is, the first parallel member, which is united with the anti-sloshing bulkhead, the second parallel member, which has a width greater than that of the first parallel member, and the support members, which connect the respective opposite edges of the first parallel member to the corresponding edges of the second parallel member, form a trapezoidal cross-section. The trapezoidal cross-sectional structure can more reliably support the anti-sloshing bulkhead, which is united with the first parallel member. However, alternatively, a rectangular stool part, in which the first and second parallel members have the same width, may be used.

Here, preferably, the first parallel member, the second parallel member, the first connection members, the second connection members and the upper ends of the support members are made of stainless steel or aluminum, which can withstand the cryogenic temperature of LNG. The lower ends of the support members which are close to the inner wall of the carrier body, are preferably made of carbon steel, which is the same material as that of the inner wall of the carrier body. As such, because the first parallel member, the second parallel member, the first connection members and the second connection members are connected to the first and second barriers, or conduct the same function as the first and second barriers of the conventional membrane type cargo tank, they are preferably made of stainless steel or aluminum, which has superior low-temperature resistance and can thus withstand the cryogenic temperature of LNG.

Moreover, a first sealed space is defined by the first parallel member, the second parallel member and the upper ends of the support members. The first sealed space preferably comprises a single space, which is defined along the outer edges of the anti-sloshing bulkhead, so that gas can be charged into the first sealed space to detect gas leakage attributable to a crack formed in the members, which defines the first sealed space. As such, the first sealed space is used as a space for charging gas, in the same manner as that of the second sealed space. For this, the first sealed space is defined by a single space, which extends along the outer edge of the anti-sloshing bulkhead, such that gas can be charged into the first sealed space to detect gas leakage attributable to a crack formed in the members, that is, the first parallel member, the second parallel member and the upper ends of the support members, which define the first sealed space. Furthermore, the first sealed space also serves as a passage used to conduct maintenance and repair of the cargo tank.

In addition, below the second sealed space, a third sealed space may be defined by the third parallel member, the lower ends of the support members, and the inner wall of the carrier body, to which the lower ends of the support members are united. Such a sealed space may be constructed such that the temperature therein can be adjusted to prevent the lower ends of the support members, which are integrated with the upper ends thereof, and the inner wall of the carrier body from being damaged by exchanging heat with the cryogenic LNG, which is contained in the cargo tank, through the upper ends of the support members.

Advantageous Effects

As describe above, in the anti-sloshing LNG cargo tank according to the present invention, the cargo tank is partitioned into the left and right spaces by the anti-sloshing bulkhead and the stool part, which supports the anti-sloshing bulkhead. Therefore, the present invention mitigates a sloshing phenomenon, thus making it possible to construct a very large cargo tank.

Furthermore, the anti-sloshing LNG cargo tank according to the present invention can be applied to a floating storage regasification unit (FSRU), which requires a very large cargo tank. Therefore, there is an advantage of making it easy to construct the FSRU.

In addition, in the anti-sloshing LNG cargo tank according to the present invention, because a pump tower, which discharges LNG outside the cargo tank, can be directly mounted to the anti-sloshing bulkhead, which is installed in the cargo tank, the problem of vibration of the pump tower in the conventional art can be solved.

BRIEF DESCRIPTION OF DRAWINGS

FIG. 3 is a view showing an embodiment of an anti-sloshing LNG cargo tank, according to the present invention;

FIG. 4 is a partial perspective view illustrating a first embodiment of an anti-sloshing bulkhead of the embodiment of FIG. 3;

FIG. 5 is a partial perspective view illustrating a second embodiment of an anti-sloshing bulkhead of the embodiment of FIG. 3;

FIG. 6 is a partial cross sectional view showing an enlargement of a first embodiment of the portion A of FIG. 3;

FIG. 7 is a partial cross sectional view showing an enlargement of a second embodiment of the portion A of FIG. 3;

FIG. 8 is a partial cross sectional view showing an enlargement of a third embodiment of the portion A of FIG. 3; and FIG. 9 is a view illustrating the concept of the cargo tank according to the embodiment of FIG. 3.

BEST MODE FOR CARRYING OUT THE INVENTION

Figure 1:
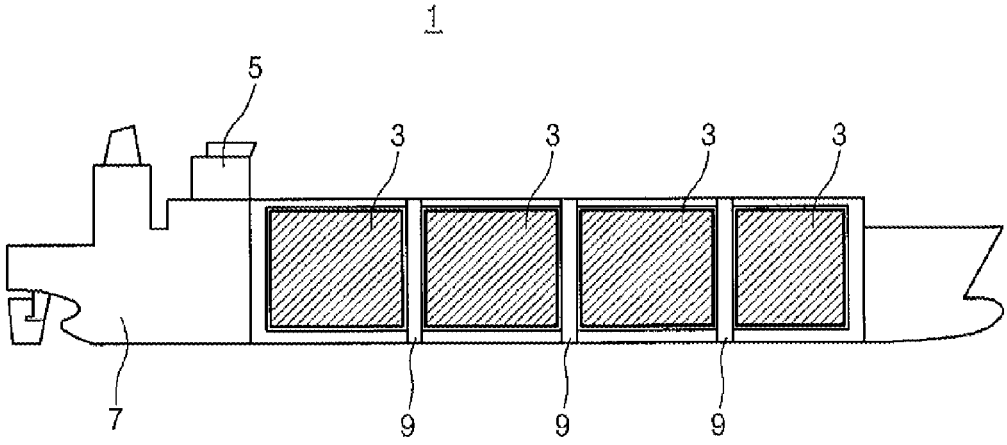
FIG. 1 (PRIOR ART)
FIG. 1 is a view showing a typical LNG carrier having cargo tanks.

Hereinafter, a preferred embodiment of an anti-sloshing LNG cargo tank according to the present invention will be described in detail.

FIG. 3 is a view showing an embodiment of an anti-sloshing LNG cargo tank, according to the present invention. FIG. 4 is a partial perspective view illustrating a first embodiment of an anti-sloshing bulkhead of the embodiment of FIG. 3. FIG. 5 is a partial perspective view illustrating a second embodiment of an anti-sloshing bulkhead of the embodiment of FIG. 3. FIG. 6 is a partial cross sectional view showing an enlargement of a first embodiment of the portion A of FIG. 3. FIG. 7 is a partial cross sectional view showing an enlargement of a second embodiment of the portion A of FIG. 3. FIG. 8 is a view illustrating the concept of the cargo tank according to the embodiment of FIG. 3.

As shown in FIG. 3, the anti-sloshing LNG cargo tank according to the present invention includes the anti-sloshing bulkhead 100, which partitions the space in the cargo tank 3 into two parts, that is, into a left space and a right space, and a stool part 200, which is adhered at a first surface thereof to an inner wall 10 of an LNG carrier and is adhered at a second surface thereof to the anti-sloshing bulkhead 100.

FIGS. 4 and 5 illustrate several embodiments of the anti-sloshing bulkhead 100 according to the embodiment of FIG. 3. The anti-sloshing bulkheads 100 and 110 will be explained in detail with reference to the corresponding drawings.

FIG. 4 is a partial perspective view illustrating a first embodiment of the anti-sloshing bulkhead of the embodiment of FIG. 3. As shown in FIG. 4, the anti-sloshing bulkhead is a structure, which is installed in the cargo tank 3, storing LNG therein, and partitions the space in the cargo tank 3 into two parts, that is, into left and right spaces. In this embodiment, the anti-sloshing bulkhead 100 is a corrugated type structure, which has a predetermined width in a longitudinal direction of the carrier body and has a zigzag shape.

The corrugated type anti-sloshing bulkhead 100 is disposed in the cargo tank 3 and extends along the longitudinal axis of the carrier body such that the space in the cargo tank 3 is partitioned into the left and right spaces. In this structure, the width of each of the left and right spaces of the cargo tank 3 is half of that of the cargo tank 3. Therefore, a sloshing phenomenon of LNG, which contained in the cargo tank, is mitigated. Furthermore, the corrugated type anti-sloshing bulkhead 100, which has a predetermined width and has a zigzag shape, is preferably configured such that it can partition the space in the cargo tank 3 into two identical spaces. The corrugated type anti-sloshing bulkhead 100 realizes a shape such that it is structurally resistant to buckling and twisting. As well, partition through holes 102 are formed through the anti-sloshing bulkhead at positions spaced apart from each other at regular intervals. LNG, which moves in the partitioned cargo tank, can freely flow between the left and right spaces through the partition through holes 102. The free flow of LNG in the cargo tank makes it possible to carry LNG from the left and right spaces of the cargo tank to the outside or from the outside thereinto using a single pump.

FIG. 5 is a partial perspective view illustrating a second embodiment of the anti-sloshing bulkhead of the embodiment of FIG. 3. As shown in FIG. 5, the plate type anti-sloshing bulkhead 110 includes a plate type partition 112, which is oriented in the longitudinal direction of the carrier body, a plurality of reinforcing stiffeners 114, which are perpendicular to the plate type partition 112 and extend in the vertical direction, and a plurality of reinforcing stringers 116, which are perpendicular to the plate type partition 112 and extend in the longitudinal direction of the carrier body.

The plate type anti-sloshing bulkhead 110 is a planar member, which is placed upright in the cargo tank 3 and extends along the longitudinal axis of the carrier body. The plate type anti-sloshing bulkhead 110 partitions the space in the cargo tank 3 into two parts, that is, into left and right spaces. Thanks to this structure, a width of each of the left and right spaces of the cargo tank 3 is half of that of the cargo tank 3. Therefore, a sloshing phenomenon of LNG, which is contained in the cargo tank, is mitigated. Unlike the corrugated type anti-sloshing bulkhead 100 shown in FIG. 4, the plate type anti-sloshing bulkhead 110 has a lot of reinforcing members, in other words, it has several reinforcing stiffeners 114 and several reinforcing stringers 116. Hence, structurally, the plate type anti-sloshing bulkhead 110 can have very high stiffness against buckling and twisting. In the same manner as those in the description of the corrugated type anti-sloshing bulkhead 100, plate holes 118 are formed through the plate type anti-sloshing bulkhead 110 at positions spaced apart from each other at regular intervals. LNG, which is contained in the cargo tank, can freely flow between the left and right spaces in the cargo tank through the plate holes 118. The free flow of LNG in the cargo tank makes it possible to carry LNG from the left and right spaces of the cargo tank to the outside or from the outside thereinto using a single pump. However, in the case of the plate type anti-sloshing bulkhead 110, because the two partitioned spaces in the cargo tank 3 cannot have the same space, unlike the corrugated type anti-sloshing bulkhead 100 shown in FIG. 4, there may be inconvenience attributable to the unevenly partitioned structure.

Therefore, preferably, depending on the standard, the intended purpose and the capacity of the cargo tank, which is provided in the LNG carrier, the corrugated type anti-sloshing bulkhead 100 of FIG. 4 or the plate type anti-sloshing bulkhead 110 of FIG. 5 is selectively used. Of course, as well as the above-mentioned two kinds of types, the anti-sloshing bulkhead can be modified into various types. Below, of the two kinds of types, the present invention will be explained based on an example using the corrugated type anti-sloshing bulkhead 100.

FIGS. 6 and 7 illustrate embodiments of the portion A of FIG. 3. Below, the portion A will be explained with reference to the corresponding drawings. The portion A shown in FIG. 6 or 7 pertains to a stool part 200 or 200*a*, which is adhered both to the carrier body inner wall 10 and to the anti-sloshing bulkhead 100, which partitions the space in the cargo tank into the left and right spaces, (here, the corrugated type anti-sloshing bulkhead is used as the anti-sloshing bulkhead) and thus fastens the anti-sloshing bulkhead 100 to the inner wall of the cargo tank.

First, the first embodiment of the portion A will be described herein below with reference to FIG. 6. The stool part 200 includes a first parallel member 202, which is united with the edge of the anti-sloshing bulkhead 100, a second parallel member 204, which is parallel to the first parallel member 202 and is spaced apart downwards from the first parallel member 202 by a predetermined distance, and support members 212, which connect the respective opposite edges of the first parallel member 202 to the corresponding edges of the second parallel member 204. The stool part 200 further includes first connection members 206, which extend from respective upper ends 214 of the support members to respective first barriers 22 and are united with the respective first barriers 22, second connection members 208, which extend from the respective upper ends 214 of the support members to respective second barriers 26 and are united with the respective second barriers 26, and a first insulation pad 210 and a second insulation pad 211 which are respectively attached to the upper and lower surfaces of the second parallel member.

Here, the first parallel member 202, the second parallel member 204, the first connection members 206, the second connection members 208, and the upper ends 214 of the support members are made of stainless steel or aluminum, and lower ends 216 of the support members are made of carbon steel, which is the same material as that of the carrier body inner wall 10.

The first parallel member 202, the second parallel member 204 and the upper ends 214 of the support members are connected to the first and second barriers 22 and 26 of the cargo tank both through the first connection members 206, which are connected to the respective first barriers 22, and through the second connection members 208, which are connected to the respective second barriers 26. Therefore, these members 202, 204, 206 and 208 are made of stainless steel or aluminum, which has superior low-temperature resistance and is equal or similar to the material of the first barrier 22. The lower ends 216 of the support members are made of carbon steel, which is different from the material of the members but is the same as or similar to the carrier body inner wall 10.

As such, the upper ends 214 of the support members are united with the first parallel member 202, the first connection members 206, the second parallel member 204 and the second connection members 208 and, therefore, must endure the cryogenic temperature transmitted from LNG. Thus, it is preferable that the upper ends 214 of the support members be made of stainless steel or aluminum, having superior low-temperature resistance. However, the lower ends 216 of the support members are united with the carrier body inner wall 10, so that they are preferably made of carbon steel, which is the same as or similar to the material of the carrier body inner wall 10. The installation positions of the upper ends 214 and the lower ends 216 of the support members are determined in consideration of the temperature of air in the cofferdam, which is the space between adjacent cargo tanks.

The second parallel member 204 is disposed below the first parallel member 202 at a position spaced apart from the first parallel member 202 by a predetermined distance such that the first and second parallel members are parallel to each other. The second parallel member 204 is made of stainless steel or aluminum, which is the same as the material of the first parallel member 202. The second parallel member 204 conducts the same function as the second barrier 26. The first insulation pad 210 and the second insulation pad 211 are respectively attached to the upper and lower surfaces of the second parallel member 204, to protect the carrier body inner wall from the cryogenic temperature of the LNG.

Meanwhile, a first sealed space 230 is defined by the first parallel member 202, the second parallel member 204, and the upper ends 214 of the support members. The first sealed space 230 forms a single space, which extends along the outer edge of the anti-sloshing bulkhead 100, and gas is charged into the first sealed space 230 to detect gas leakage, attributable to a crack formed in the stool part 200. In the conventional art, after the cargo tanks have been constructed, in order to inspect whether a crack is present in the first and second barriers 22 and 26, pressure inspection using a method of charging gas is necessarily conducted. In the same manner, after the installation of the stool part 200 has been completed, in order to inspect whether a crack is present in the first parallel member 202, the second parallel member 204, the first connection members 206, the second connection members 208, and the upper ends 214 of the support members, which constitute the stool part 200, pressure inspection using a method of charging gas is conducted. At this time, the first sealed space 230 is used as a space for charging gas. Furthermore, the first sealed space 230 serves as a passage used to conduct maintenance and repair of the cargo tank.

Below the first sealed space 230, a third sealed space 240 is defined by the second parallel member 204, the lower ends 216 of the support members, and the carrier body inner wall 10, to which the lower ends 216 of the support members are united. The third sealed space is constructed such that the temperature therein can be adjusted to prevent the lower ends 216 of the support members, which are integrated with the upper ends 214 thereof, and the carrier body inner wall 10 from being damaged by the exchange of heat with the cryogenic LNG, which is contained in the cargo tank, through the upper ends 214 of the support members.

Next, a second embodiment of the portion A will be described herein below with reference to FIG. 7. A stool part 200*a* supports each of the front and rear ends of the anti-sloshing bulkhead 100. Unlike the stool part 200 of the first embodiment of FIG. 6, a first parallel member 202*a* and a second parallel member 204*a* have the same width. Furthermore, support members 212*a*, which connect the first parallel member 202*a* and the second parallel member 204*a* to each other, and are perpendicularly united with the carrier body inner wall 10. The stool part 200*a*, which has a rectangular shape, as described above, has reduced support force compared to that of the stool part 200 of the first embodiment of FIG. 6. Therefore, it is not suitable to use the stool part 200*a* at a position at which the anti-sloshing bulkhead 100 is supported in the vertical direction, that is, on the upper or lower end of the anti-sloshing bulkhead 100, but the stool part 200*a* can be used on the front or rear end of the anti-sloshing bulkhead 100. The general shape and construction of the stool part 200*a*, with the exception of the above-mentioned structure, remains the same as the stool part 200 of the first embodiment of FIG. 6, therefore further explanation is deemed unnecessary.

Next, a third embodiment of the portion A will be described herein below with reference to FIG. 8. A stool part of the third embodiment of FIG. 8 is similar to that of the first embodiment of FIG. 6, therefore only differences therebetween will be briefly explained herein below.

Referring to FIG. 8, unlike the first embodiment, the third embodiment further includes a third parallel member 213, which is disposed below a second parallel member 204 at a position spaced apart from the second parallel member 204 by a predetermined distance, and the opposite edges of which are united with the respective upper ends 214 of the support members.

In this case, a first insulation pad 210 is attached to the lower surface of the second parallel member 204. The third parallel member 213 is spaced apart downwards from the first insulation pad 210 by a predetermined distance, and a second insulation pad 211 is attached to the lower surface of the third parallel member 213. A second sealed space 250 is defined between the lower surface of the first insulation pad 210 and the upper surface of the third parallel member 213. In addition, a third sealed space 240 is defined between the lower surface of the second insulation pad 211 and the upper surface of the carrier body inner wall 10, in the same manner as that in the description of the first embodiment.

The third parallel member 213 is made of stainless steel or aluminum, which is the same as or similar to the material of the second parallel member 204. The second sealed space 250 is used as a space for charging gas, in the same manner as the first sealed space 230 of the first embodiment.

Here, the second sealed space 250 forms a single space, which extends along the outer edge of the anti-sloshing bulkhead 100, and gas is charged into the second sealed space in order to detect gas leakage attributable to cracks formed in the members, that is, the second parallel member 204, the third parallel member 213 and the upper ends 214 of the support members, which define the second sealed space 250. Furthermore, the second sealed space 250 serves as a passage for conducting maintenance and repair of the cargo tank.

Figure 2:
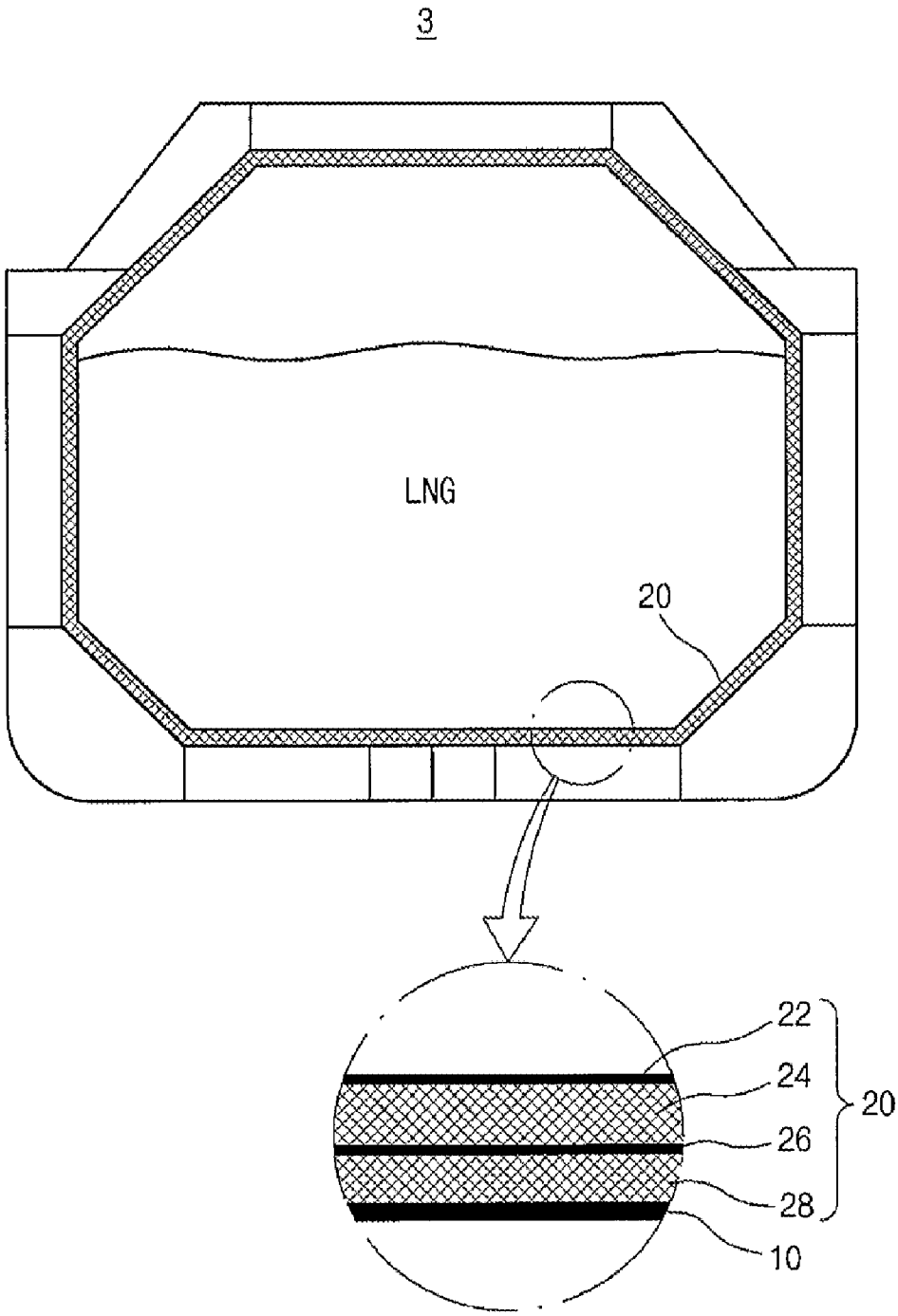
FIG. 2 (PRIOR ART)
FIG. 2 is a cross sectional view showing a conventional cargo tank.

FIG. 9 is a view illustrating the concept of the cargo tank according to the embodiment of FIG. 3. The internal structure of the LNG tank having the anti-sloshing function will be explained with reference to FIG. 9. Unlike the cargo tank 3 of FIG. 2, the cargo tank according to the preferred embodiment of the present invention is partitioned into two parts, that is, left and right spaces. This structure is realized by the anti-sloshing bulkhead 100, which extends in the longitudinal direction of the carrier body and partitions the space in the cargo tank into the left and right spaces. The anti-sloshing bulkhead 100 is coupled to the cargo tank both through the trapezoidal stool parts 200, which support the anti-sloshing bulkhead 100 in the vertical direction, and through the rectangular stool parts 200*a*, which support the anti-sloshing bulkhead 100 in the longitudinal direction. In this embodiment, although this structure is designed in consideration of the fact that a larger force is applied to the anti-sloshing bulkhead 100 in the vertical direction, the structure may be modified.

As such, the cargo tank is partitioned into the left and right spaces by the anti-sloshing bulkhead 100 and the stool parts 200 and 200*a*, which support the anti-sloshing bulkhead 100. LNG is stored in the left and right spaces of the partitioned cargo tank. Typically, as the volume of the cargo tank, which contains LNG, is reduced, a sloshing phenomenon, which is caused by LNG in the cargo tank, is mitigated. Therefore, compared to the conventional cargo tank of FIG. 2, the present invention can have an effect of mitigating the sloshing phenomenon. Furthermore, in the anti-sloshing LNG cargo tank according to the present invention, a plurality of anti-sloshing bulkheads 100 and a corresponding number of stool parts 200 and 200*a* may be provided. Hence, the present invention makes it possible to construct a very large cargo tank. In addition, in the present invention, because a pump tower 300, which discharges LNG outside the cargo tank, can be installed on the sidewall of the anti-sloshing bulkhead 100, the problem of vibration in the conventional hanging type pump tower can be solved.

In the above-mentioned embodiment, only the structure in which the anti-sloshing bulkhead 100 is oriented in the longitudinal direction of the carrier body has been illustrated. However, as modifications of the embodiment, the anti-sloshing bulkhead 100 may be oriented in the lateral direction of the carrier body, or the anti-sloshing bulkheads 100 may be installed such that they are oriented in the longitudinal direction and in the lateral direction, and thus cross each other. These modifications must be regarded as falling within the bounds of the present invention.

Although preferred embodiments of the anti-sloshing LNG cargo tank according to the present invention have been described, those skilled in the art will appreciate that various modifications, additions and substitutions are possible, without departing from the technical scope and essential characteristics of the present invention.

Therefore, the above-mentioned embodiments must be appreciated as being only illustrative examples, without limiting the present invention. The scope of the present invention must be defined by the accompanying claims rather than the above description. In addition, all modifications, additions and substitutions, which can be deduced from the accompanying claims and equivalents thereto, must be understood as falling within the bounds of the present invention.

The invention claimed is:

1. An anti-sloshing LNG cargo tank, having a first barrier for preventing leakage of a cryogenic LNG, and a second barrier and an insulation pad provided to supplement the first barrier in combination with an LNG carrier body having an inner wall, the anti-sloshing LNG cargo tank comprising:

an anti-sloshing bulkhead for partitioning a space in the LNG cargo tank into a plurality of spaces to reduce a sloshing phenomenon of the LNG that moves in the LNG cargo tank; and a stool part united at a first surface of the stool part to the inner wall of the LNG carrier body and united at a second surface of the stool part to the anti-sloshing bulkhead to fasten the anti-sloshing bulkhead to the inner wall of the LNG cargo tank, the stool part being coupled to the first barrier and the second barrier and having the insulation pad therein, thus preventing the cryogenic LNG from leaking towards the inner wall of the LNG carrier body or from exchanging heat with the inner wall of the LNG carrier body.

wherein the stool part comprises:

a first parallel member united with an edge of the anti-sloshing bulkhead;

a second parallel member disposed below the first parallel member;

a first support member connecting one edge of the first parallel member to one edge of the second parallel member and a second support member connecting the other edge of the first parallel member to the other edge of the second parallel member, the first and the second support member extending to the inner wall of the LNG cargo tank;

first connection members extending from the first and the second support member respectively, to the first barrier, the first connection members being united with the first barrier; and second connection members extending from the first and the second support member, respectively, to the second barrier, the second connection members being united with the second barrier, wherein a plurality of insulation pads are provided on or under the second parallel member, and wherein said one edge of the second parallel member is connected to the first support member and said other edge of the second parallel member is connected to the second support member so that the second parallel member is parallel to the first parallel member.

2. The anti-sloshing LNG cargo tank according to claim 1, wherein the anti-sloshing bulkhead has a zigzag corrugated shape.

3. The anti-sloshing LNG cargo tank according to claim 1, wherein the anti-sloshing bulkhead comprises:

a plate type partition;

a stiffener coupled to the plate type partition in a direction perpendicular thereto, the stiffener being oriented in a vertical direction; and a stringer coupled to the plate type partition in a direction perpendicular thereto, the stringer being oriented in a longitudinal direction.

4. The anti-sloshing LNG cargo tank according to claim 1, wherein a hole is formed through the anti-sloshing bulkhead so that the LNG flows between the spaces partitioned in the LNG cargo tank through the hole.

5. The anti-sloshing LNG cargo tank according to claim 1, further comprising:

a third parallel member provided below the second parallel member, wherein one edge of the third parallel member is connected to the first support member and the other edge of the third parallel member is connected to the second support member so that the third parallel member is parallel to the first parallel member.

6. The anti-sloshing LNG cargo tank according to claim 5, wherein a sealed space is defined by the second parallel member, the third parallel member and the upper ends of the first and the second support member, the sealed space comprising a single space defined along outer edges of the anti-sloshing bulkhead, so that gas is charged into the sealed space to detect gas leakage attributable to a crack formed in the corresponding members.

* * * * *